US006323602B1

(12) United States Patent
De Groot et al.

(10) Patent No.: US 6,323,602 B1
(45) Date of Patent: Nov. 27, 2001

(54) COMBINATION EQUALIZING TRANSFORMER AND BALLAST CHOKE

(75) Inventors: Hendrik W. J. De Groot; Petrus C. J. Laros, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/519,553

(22) Filed: Mar. 6, 2000

(30) Foreign Application Priority Data

Mar. 9, 1999 (EP) ..... 99200693

(51) Int. Cl.[7] ..... H05B 41/16

(52) U.S. Cl. ..... 315/276; 323/355; 336/12; 336/15; 336/20; 336/170

(58) Field of Search ..... 315/276, 283, 315/291, 57; 323/355; 336/15, 12, 20, 110, 117, 170, 213, 225

(56) References Cited

U.S. PATENT DOCUMENTS 3,631,534 * 12/1971 Hirota et al. ..... 336/115
4,004,185 * 1/1977 Edmondson et al. ..... 315/105
4,613,841 * 9/1986 Roberts ..... 336/83
4,910,482 * 3/1990 Takagai et al. ..... 333/181
4,940,921 * 7/1990 Helling et al. ..... 315/219
5,083,101 * 1/1992 Frederick ..... 333/181
5,119,059 * 6/1992 Covi et al. ..... 336/175
5,155,676 * 10/1992 Spreen ..... 363/126
5,313,176 5/1994 Upadhyay ..... 333/181
5,432,406 * 7/1995 Brooks ..... 315/94
5,469,028 * 11/1995 Nilssen ..... 315/291
5,568,018 * 10/1996 Muzic ..... 315/276

* cited by examiner

*Primary Examiner*—Don Wong
*Assistant Examiner*—Thuy Vinh Tran

(57) ABSTRACT

A ballast circuit includes an equalizer transformer for equalizing current between two or more lamps operated in parallel, combined on one core with a choke. In a 2-lamp embodiment, four windings are provided on one main core. The first and second are closely coupled and have N turns each, each connected separately to one of the lamps. A third and fourth winding are loosely coupled with respect to each other, and are arranged symmetrically about the first and second windings on the main core. These latter windings may be connected in series or in parallel to be an inductive impedance in the ballast circuit.

8 Claims, 2 Drawing Sheets

COMBINATION EQUALIZING TRANSFORMER AND BALLAST CHOKE

BACKGROUND OF THE INVENTION

The invention relates to a circuit arrangement for operating two or more lamps in parallel, equipped with an equalizer transformer comprising a main core of magnetizable material around which a first winding and a second winding are provided, the first and second winding each comprising a number of turns substantially equal to N, said first and second winding during operation being connected in series with respective lamps, inductive ballast means.

The invention also relates to an inductive component.

A circuit arrangement as mentioned in the first paragraph is known from EP 0766500-A1. The known circuit arrangement is widely used for supplying low-pressure mercury discharge lamps. In the known circuit arrangement the equalizer transformer fulfils two functions. First of all, during ignition, after the first lamp has ignited, the equalizer transformer makes sure that the voltage over the lamp that has not yet ignited is high enough to realize the ignition of that lamp. In the second place, during steady state operation the equalizer transformer makes sure that the currents flowing through the lamps are substantially equal. The inductive ballast means is normally formed by a single choke that is in series with both lamps. The function of the inductive ballast means is to limit the current flowing through the lamps. A disadvantage of the known circuit arrangement is that the total number of components comprised in the circuit arrangement is comparatively high so that it is relatively complicated and therefore expensive to manufacture the circuit arrangement.

BRIEF SUMMARY OF THE INVENTION

The invention aims to provide a circuit arrangement that comprises only a comparatively small number of components.

A circuit arrangement as mentioned in the opening paragraph is therefor according to the invention characterized in that the inductive ballast means comprise a third winding and a fourth winding around the core of magnetizable material, said third and said fourth winding each comprising a number of turns substantially equal to M, and in that the third and the fourth winding are arranged symmetrically with respect to the first and second winding.

The equalizer transformer and the inductive ballast means have been integrated into a single inductive component in a circuit arrangement according to the invention. The process of assembling a circuit arrangement according to the invention and its integration in a compact lamp are comparatively simple as a result of this.

Since the third and fourth winding comprise a substantially equal number of turns and they are arranged symmetrically with respect to the first and second winding, the magnetic fluxes through the third and fourth winding hardly interfere with the functioning of the first and the second winding during operation. In other words there is hardly any interaction between the inductive ballast means and the equalizer transformer. The third and the fourth winding are so arranged that during operation there is only a relatively small magnetic coupling between them; that is, they are loosely coupled magnetically. Because of this relatively small magnetic coupling the third and fourth winding can together form an inductor. The first and the second winding, however, are so arranged that during operation, there exists a good magnetic coupling between them; that is, they are loosely coupled magnetically. This good coupling is necessary for the first and second winding to form an equalizer transformer. The magnetic coupling between the first and the second winding is good when the two windings are close together on the main core. The magnetic coupling can be further improved by forming the first and second winding as a bifilar winding. In this case the first and the second winding are not just close to each other but occupy the same space.

Preferably the first winding and the second winding are arranged between the third and the fourth winding. In such an arrangement the coupling between the first and second winding can be good since they can be close together. At the same time the third and fourth winding are separated from each other by the first and second winding so that the coupling between the third and fourth winding is relatively small.

A circuit arrangement according to the invention preferably comprises a first E-core and a second E-core formed out of magnetizable material, wherein the end surfaces of the transverse legs of the first E-core are facing the end surfaces of the second E-core, and wherein the first winding and the third winding surround the middle transverse leg of the first E-core, while the second and the fourth winding surround the middle transverse leg of the second E-core.

In another preferred embodiment of a circuit arrangement according to the invention, the main core comprises a first U-core and a second U-core formed out of magnetizable material, wherein the end surfaces of the transverse legs of the first U-core are facing the end surfaces of the transverse legs of the second U-core and wherein the first winding and the third winding surround a first transverse leg of the first U-core, while the second and the fourth winding surround a first transverse leg of the second U-core, the end surface of the first transverse leg of the first U-core facing the end surface of the first transverse leg of the second U-core. In practice it has been found that the performance of a main core comprising two U-cores is not as good as the performance of a main core comprising two E-cores, but in the first case less magnetizable material needs to be used, so that the circuit arrangement can be smaller and cheaper.

It be mentioned that, for instance in U.S. Pat. No. 5,313,176, an inductive component is disclosed in which the functions of two chokes and a transformer are integrated. This inductive component comprises only two windings and is very suitable for use e.g. in an EMI/RFI filter. However, since both functions of the component strongly influence each other, the chokes and the transformer cannot be used independently, or more particularly conduct different currents. For these reasons the inductive component disclosed in U.S. Pat. No. 5,313,176 is not suitable for use as an integrated equalizer transformer plus inductive ballast means in a circuit arrangement according to the present invention.

BRIEF DESCRIPTION OF THE SEVERAL VIEWS OF THE DRAWING

Embodiments of the invention will be explained in detail with reference to a drawing, in which.

DETAILED DESCRIPTION OF THE INVENTION

Figure 1A:
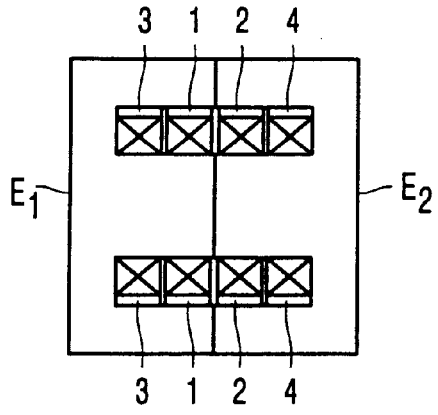
FIG. 1A shows an embodiment of an inductive component according to the invention.

In FIG. 1A, E1 and E2 are two E-cores formed out of magnetizable material together forming a main core. The end surfaces of the transverse legs of the first E-core E1 are facing the end surfaces of the second E-core E2. 1 and 2 are first and second windings surrounding the transverse middle leg of the first E-core E1 and the middle transverse leg of the second E-core E2 respectively. Since the first and second winding are very close together there is a good magnetic coupling between them. The first winding 1 and the second winding 2 together with the two E-cores E1 and E2 form an equalizer transformer. A third winding 3 surrounds the middle transverse leg of the first E-core E1, while a fourth winding 4 surrounds the middle transverse leg of the second E-core E2. Because the third and the fourth winding are separated from each other by the other windings the magnetic coupling between the first and the second winding is relatively small. For this reason the third winding 3 and the fourth winding 4 together with the two E-cores form an inductor that can be used as an inductive ballast means. The first winding 1 and the second winding 2 each comprise a number of turns that is substantially equal to N, while the third winding 3 and the fourth winding 4 each comprise a number of turns substantially equal to M. The first winding 1 and the second winding 2 are arranged between the third winding 3 and the fourth winding 4. During operation of the inductive component shown in FIG. 1 the first winding and the second winding are so connected that each of them carries substantially the same amount of current and that the magnetic fluxes generated by them substantially cancel each other. Similarly the third and fourth winding are so connected that during operation they carry substantially the same amount of current and that the fluxes generated by them substantially cancel each other in the part of the main core that is surrounded by the first and the second winding. Consequently the part of the inductive component that forms the inductive ballast means does not interact with the functioning of the part of the inductive component that forms the equalizer transformer.

In the other embodiments shown in FIG. 1, similar parts are indicated by means of the same reference numerals. The embodiment shown in FIG. 1B only differs from the embodiment in FIG. 1A in that the first winding and the second winding are implemented as a bifilar winding. This feature further improves the coupling between the first and the second winding so that the performance of this embodiment is slightly better than that of the embodiment shown in FIG. 1A.

Figure 1B:
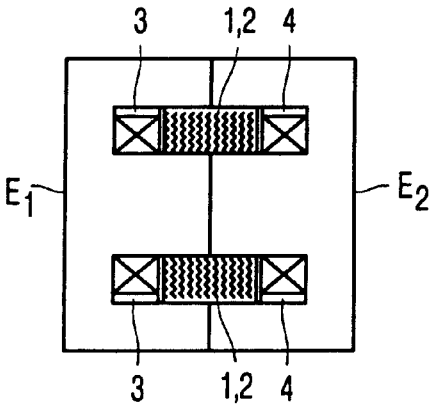
FIG. 1B shows an embodiment of an inductive component according to the invention.
Figure 1C:
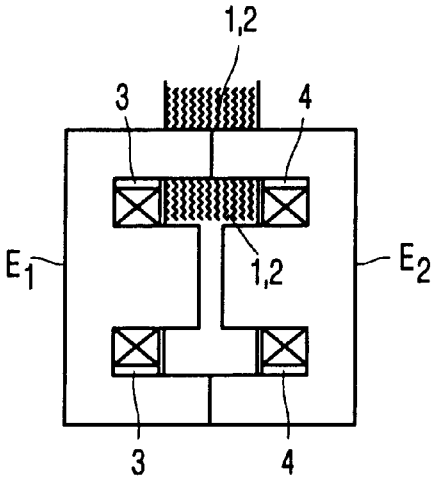
FIG. 1C shows an embodiment of an inductive component according to the invention.

The embodiment in FIG. 1C differs from the one in FIG. 1B in that the bifilar winding is not round the middle transverse legs of the E-cores but round two of the side transverse legs of the E-cores. To decrease the magnetic coupling between the third and the fourth winding, an air gap is present between the end surfaces of the middle transverse legs of both E-cores. In this embodiment the equalizer transformer and the ballast inductor are even more magnetically decoupled than in the embodiment in FIG. 1B., so that the performance is slightly improved.

Figure 1D:
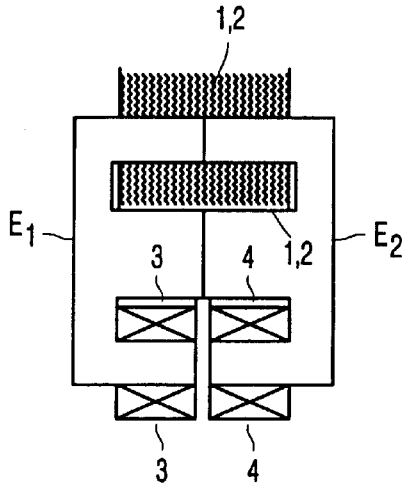
FIG. 1D shows an embodiment of an inductive component according to the invention.

In the embodiment in FIG. 1D, the first and second windings are formed by a bifilar winding around two of the side transverse legs of the E-cores, while the third and the fourth winding are each around a further side transverse leg of an E-core. In this embodiment the magnetic coupling between the equalizer and the ballast inductor is further reduced with respect to the embodiment in FIG. 1C. An air gap is present between the third and the fourth winding to reduce the magnetic coupling between them. The overall performance of this component is very similar to that of the embodiment in FIG. 1A.

Figure 1E:
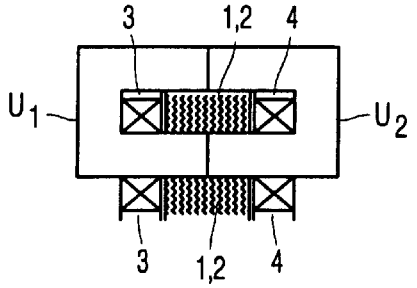
FIG. 1E shows an embodiment of an inductive component according to the invention.

In the embodiment in FIG. 1E use is made of two U-cores, U1 and U2, instead of two E-cores. The bifilar winding that forms the first and the second winding surrounds a first transverse leg of the first U-core U1 and a first transverse leg of the second U-core U2. The third winding surrounds the first transverse leg of the first U-core U1 and the fourth winding surrounds the first transverse leg of the second U-core U2. In this embodiment less magnetizable material is used so that this embodiments is relatively cheap. In practice, however, the performance of this embodiment is found to be not as good as that of the embodiments comprising two E-cores.

Figure 2:
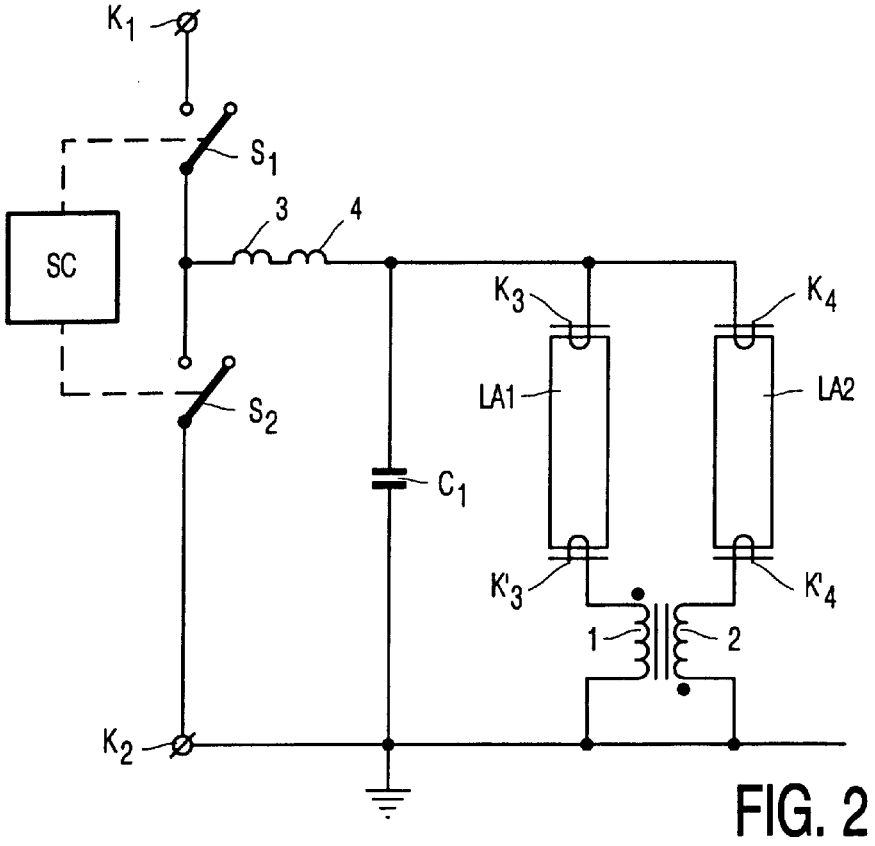
FIG. 2 shows an embodiment of a circuit arrangement according to the invention comprising such an inductive component, together with two lamps.

In FIG. 2, K1 and K2 are input terminals suitable for connection to a DC voltage supply source. Input terminals K1 and K2 are connected by means of a series arrangement of switching elements S1 and S2. Control electrodes of switching elements S1 and S2 are connected to respective output terminals of a control circuit SC for rendering the switching elements alternately conductive and non-conductive. Switching element S2 is shunted by series arrangement of third winding 3, fourth winding 4 and capacitor C1, K3, K3', K4 and K4' are terminals for lamp connection. Capacitor C1 is shunted by a first series arrangement of terminal K3, lamp LA1, terminal K3' and first winding 1. Capacitor C1 is also shunted by a second series arrangement of terminal K4, lamp LA2, terminal K4' and second winding 2.

The operation of the circuit arrangement shown in FIG. 2 is as follows.

In case a DC voltage source is connected to input terminals K1 and K2, the control circuit SC renders the switching elements S1 and S2 alternately conductive and non-conductive. As a result an AC-voltage is present over capacitor C1. In case for example lamp LA1 ignites as a result of the presence of this AC voltage, the first winding 1 will carry a current. Because of the good magnetic coupling between the first and the second winding, the current through the first winding induces a voltage over the second winding. The voltage present over the second lamp is the sum of the voltage over capacitor C1 and the voltage over the second winding 2. Although the voltage over capacitor C1 has decreased after the ignition of lamp LA1, this sum voltage is high enough to ignite the lamp LA2.

After both lamps have ignited both the first and the second winding carry a current that is equal to the current through lamp LA1 and the current through lamp LA2 respectively. If the currents through both lamps are substantially equal the magnetic coupling between the first and the second winding causes an induced voltage over each of the windings that substantially cancels the voltage that is present over each of the windings because of the current it carries. However, if for instance the lamp current through lamp LA1 is larger than that through lamp LA2, the voltage over the second winding that is induced by the magnetic coupling between the first and the second winding is higher than the voltage that is present over the second winding because of the current this second winding carries. As a result both voltages present over the second winding do not completely cancel each other and a rest voltage is present over the second winding. For similar reasons a rest voltage with a substantially equal amplitude but of opposite polarity is present over the first winding. The rest voltage present over the first winding forces the current through lamp LA1 to decrease while the rest voltage present over the second winding forces the current through lamp LA2 to increase. As a result the currents through each of the lamps are maintained substantially equal during steady-state operation.

In the circuit shown in FIG. 2 the third winding and the fourth winding are arranged in series and each carry a current that is twice as large as the current through each of the first and the second windings. Alternatively the third winding can be arranged in parallel with the fourth winding. An important advantage of the topology shown in FIG. 2, however, is the fact that the third and the fourth winding always carry the same current.

What is claimed is:

1. A circuit arrangement for operating two or more lamps in parallel, comprising an equalizer transformer comprising a main core of magnetizable material around which a first winding and a second winding are provided, arranged to be closely coupled magnetically by said main core during operation, the first winding and the second winding each comprising a number of turns substantially equal to N, said first winding and said second winding each having a respective lamp-connection end free from connection to the other lamp-connection end, said first winding and said second winding during operation being connected in series with respective lamps, and inductive ballast means, characterized in that the inductive ballast means comprises a third winding and a fourth winding around the main core of magnetizable material, said third winding and said fourth winding each comprising a number of turns substantially equal to M, the third and the fourth winding are arranged to be loosely coupled magnetically to each other during operation, and are arranged symmetrically with respect to the first winding and the second winding, and said third winding and said fourth winding are each free from connection to either lamp-connection end, wherein the first winding and the second winding are arranged between the third and the fourth winding.

2. A circuit arrangement for operating two or more lamps in parallel, comprising an equalizer transformer comprising a main core of magnetizable material around which a first winding and a second winding are provided, arranged to be closely coupled magnetically by said main core during operation, the first winding and the second winding each comprising a number of turns substantially equal to N, said first winding and said second winding each having a respective lamp-connection end free from connection to the other lamp-connection end, said first winding and said second winding during operation being connected in series with respective lamps, and inductive ballast means, characterized in that the inductive ballast means comprises a third winding and a fourth winding around the main core of magnetizable material, said third winding and said fourth winding each comprising a number of turns substantially equal to M, the third and the fourth winding are arranged to be loosely coupled magnetically to each other during operation, and are arranged symmetrically with respect to the first winding and the second winding, and said third winding and said fourth winding are each free from connection to either lamp-connection end, wherein the first winding and the second winding are together formed by a bifilar winding.

3. A circuit arrangement for operating two or more lamps in parallel, comprising an equalizer transformer comprising a main core of magnetizable material around which a first winding and a second winding are provided, arranged to be closely coupled magnetically by said main core during operation, the first winding and the second winding each comprising a number of turns substantially equal to N, said first winding and said second winding each having a respective lamp-connection end free from connection to the other lamp-connection end, said first winding and said second winding during operation being connected in series with respective lamps, and inductive ballast means, characterized in that the inductive ballast means comprises a third winding and a fourth winding around the main core of magnetizable material, said third winding and said fourth winding each comprising a number of turns substantially equal to M, the third and the fourth winding are arranged to be loosely coupled magnetically to each other during operation, and are arranged symmetrically with respect to the first winding and the second winding, and said third winding and said fourth winding are each free from connection to either lamp-connection end, wherein the main core comprises a first E-core and a second E-core formed out of magnetizable material, wherein the end surfaces of the transverse legs of the first E-core are facing the end surfaces of the transverse legs of the second E-core and wherein the first winding and the third winding surround the middle transverse leg of the first E-core, while the second and the fourth winding surround the middle transverse leg of the second E-core.

4. A circuit arrangement for operating two or more lamps in parallel, comprising an equalizer transformer comprising a main core of magnetizable material around which a first winding and a second winding are provided, arranged to be closely coupled magnetically by said main core during operation, the first winding and the second winding each comprising a number of turns substantially equal to N, said first winding and said second winding each having a respective lamp-connection end free from connection to the other lamp-connection end, said first winding and said second winding during operation being connected in series with respective lamps, and inductive ballast means, characterized in that the inductive ballast means comprises a third winding and a fourth winding around the main core of magentizable material, said third winding and said fourth winding each comprising a number of turns substantially equal to M, the third and the fourth winding are arranged to be loosely coupled magnetically to each other during operation, and are arranged symmetrically with respect to the first winding and the second winding, and said third winding and said fourth winding are each free from connection to either lamp-connection end, wherein the main core comprises a first U-core and a second U-core formed out of magnetizable material, wherein the end surfaces of the transverse legs of the first U-core are facing the end surfaces of the second U-core and wherein the first winding and the third winding surround a first transverse leg of the first U-core, while the second and the fourth winding surround a first transverse leg of the second U-core, the end surface of the first transverse leg of the first U-core facing the end surface of the first transverse leg of the second U-core.

5. An inductive component for use in a circuit arrangement for operating two or more lamps in parallel, comprising an equalizer transformer comprising a main core of magnetizable material around which a first winding and a second winding are provided, arranged to be closely coupled magnetically by said main core during operation, the first winding and the second winding each comprising a number of turns substantially equal to N, said first winding and said second winding each having a respective lamp-connection end free from connection to the other lamp-connection end, characterized in that the component further comprises an inductive ballast means comprising a third winding and a fourth winding around the main core of magnetizable material, said third winding and said fourth winding each comprising a number of turns substantially equal to M, the third and the fourth winding are arranged to be loosely coupled magnetically to each other during operation, and are arranged symmetrically with respect to the first winding and the second winding, and said third winding and said fourth winding are each free from connection to either lamp-connection end, wherein the first winding and the second winding are arranged between the third and the fourth winding.

6. An inductive component for use in a circuit arrangement for operating two or more lamps in parallel, comprising an equalizer transformer comprising a main core of magnetizable material around which a first winding and a second winding are provided, arranged to be closely coupled magnetically by said main core during operation, the first winding and the second winding each comprising a number of turns substantially equal to N, said first winding and said second winding each having a respective lamp-connection end free from connection to the other lamp-connection end, characterized in that the component further comprises an inductive ballast means comprising a third winding and a fourth winding around the main core of magnetizable material, said third winding and said fourth winding each comprising a number of turns substantially equal to M, the third and the fourth winding are arranged to be loosely coupled magnetically to each other during operation, and are arranged symmetrically with respect to the first winding and the second winding, and said third winding and said fourth winding are each free from connection to either lamp-connection end, wherein the first winding and the second winding are together formed by a bifilar winding.

7. An inductive component for use in a circuit arrangement for operating two or more lamps in parallel, comprising an equalizer transformer comprising a main core of magnetizable material around which a first winding and a second winding are provided, arranged to be closely coupled magnetically by said main core during operation, the first winding and the second winding each comprising a number of turns substantially equal to N, said first winding and said second winding each having a respective lamp-connection end free from connection to the other lamp-connection end, characterized in that the component further comprises an inductive ballast means comprising a third winding and a fourth winding around the main core of magnetizable material, said third winding and said fourth winding each comprising a number of turns substantially equal to M, the third and the fourth winding are arranged to be loosely coupled magnetically to each other during operation, and are arranged symmetrically with respect to the first winding and the second winding, and said third winding and said fourth winding are each free from connection to either lamp-connection end, wherein the component comprises a first E-core and a second E-core formed out of magnetizable material, wherein the end surfaces of the transverse legs of the first E-core are facing the end surfaces of the transverse legs of the second E-core, and wherein the first winding and the third winding surround the middle transverse leg of the first E-core, while the second and the fourth winding surround the middle transverse leg of the second E-core.

8. An inductive component for use in a circuit arrangement for operating two or more lamps in parallel, comprising an equalizer transformer comprising a main core of magnetizable material around which a first winding and a second winding are provided, arranged to be closely coupled magnetically by said main core during-operation, the first winding and the second winding each comprising a number of turns substantially equal to N, said first winding and said second winding each having a respective lamp-connection end free from connection to the other lamp-connection end, characterized in that the component further comprises an inductive ballast means comprising a third winding and a fourth winding around the main core of magnetizable material, said third winding and said fourth winding each comprising a number of turns substantially equal to M, the third and the fourth winding are arranged to be loosely coupled magnetically to each other during operation, and are arranged symmetrically with respect to the first winding and the second winding, and said third winding and said fourth winding are each free from connection to either lamp-connection end, wherein the main core comprises a first U-core and a second U-core formed out of magnetizable material, wherein the end surfaces of the transverse legs of the first U-core are facing the end surfaces of the transverse legs of the second U-core and wherein the first winding and the third winding surround a first transverse leg of the first U-core, while the second and the fourth winding surround a first transverse leg of the second U-core, the end surface of the first transverse leg of the first U-core facing the end surface of the first transverse leg of the second U-core.

* * * * *